United States Patent [19]

Lowe

[11] Patent Number: 4,765,013

[45] Date of Patent: Aug. 23, 1988

[54] GUTTER BROOM SEGMENT AND ASSEMBLY

[75] Inventor: James T. Lowe, Fontana, Calif.

[73] Assignee: FMC Corporation, Chicago, Ill.

[21] Appl. No.: 811,205

[22] Filed: Dec. 20, 1985

[51] Int. Cl.[4] ..... A46B 3/16

[52] U.S. Cl. ..... 15/180; 15/198

[58] Field of Search ..... 15/50 R, 180, 196, 197, 15/198

[56] References Cited

U.S. PATENT DOCUMENTS

| | | | |
|---|---|---|---|
| 1,564,226 | 12/1925 | Finnell | 15/180 |
| 1,694,737 | 12/1928 | Finnell | 15/50 R |
| 2,242,577 | 5/1941 | Finnell | 15/180 |
| 3,289,234 | 12/1966 | Nelson | 15/181 X |
| 3,526,919 | 9/1970 | Byers | 15/198 X |
| 3,678,530 | 7/1972 | Horton et al. | 15/180 |
| 3,875,607 | 4/1975 | Rosseau | 15/180 |
| 4,399,578 | 8/1983 | Bordeaux | 15/230 X |

FOREIGN PATENT DOCUMENTS

| | | | |
|---|---|---|---|
| 151553 | 10/1981 | German Democratic Rep. | 15/180 |
| 450523 | 7/1949 | Italy | 15/180 |
| 906814 | 9/1962 | United Kingdom | 15/50 R |
| 1420525 | 1/1976 | United Kingdom | 15/180 |

*Primary Examiner*—Wm. Carter Reynolds

*Attorney, Agent, or Firm*—Christie, Parker & Hale

[57] ABSTRACT

The brush segments of a gutter broom have self-locking lugs that are received in holes in the broom's drive plate to mount the segments. Dogs of the segments spring into at least some of the holes to keep the segments from unlocking.

13 Claims, 3 Drawing Sheets

FIG_1
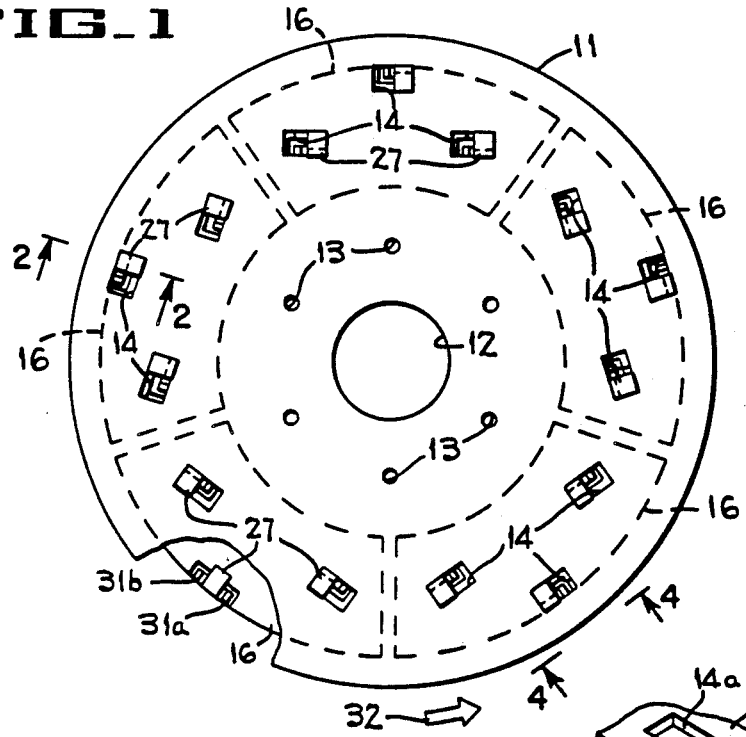
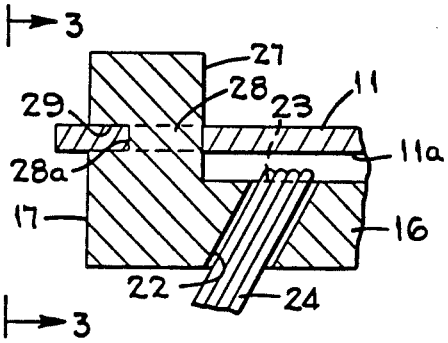
FIG_2
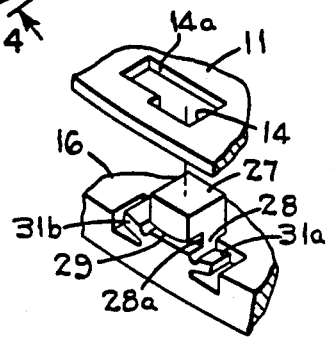
FIG_4
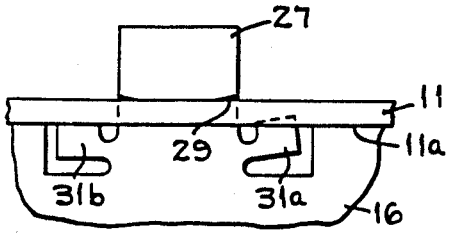
FIG_3

GUTTER BROOM SEGMENT AND ASSEMBLY

BACKGROUND OF THE INVENTION

This invention relates to a gutter broom assembly and more particularly to a gutter brush segment configured for quick and easy attachment to a gutter broom support plate.

SUMMARY OF THE INVENTION

An improved broom is disclosed which is used on a surface sweeper and has bristles projecting downwardly from the lower bearing surface of a broom support plate. The support plate is coupled to a power source which drives the broom rotationally. A plurality of brush segments underlie the support plate bearing surface and hold the downwardly projecting bristles. The segments attach to the support plate by lug means inserted through a pattern of complementary holes in the support plate. The lugs are configured for engagement in the lug holes by movement of each of the brush segments along the plate bearing surface in a direction parallel thereto. Locking means are coupled to the lug means for securing the lug means within the lug holes and thereby the brush segments to the bearing surface of the support plate.

A segment is disclosed for use in a surface sweeping broom, wherein a broom support plate is adapted to be driven rotationally and has a pattern of lug holes formed therethrough about a broom segment mounting radius. A brush body has an elongate dimension for disposal in a position substantially tangential to a curve described by the mounting radius on the support plate. The body has a plurality of pairs of bristle passages therein and a wall between each hole in the pairs of passages for supporting the bight of a folded bristle bundle. A plurality of lugs extends from the brush body and is disposed in a pattern corresponding to a portion of the lug hole pattern in the support plate. As a consequence, the brush body is fixed to one surface of the support plate when the lugs are inserted in the lug hole pattern portion.

BRIEF DESCRIPTION OF THE DRAWING

FIG. 1 is a top plan view of a brush support plate with underlying brush segments shown in dashed lines incorporating the present invention.

FIG. 2 is a partial sectional view taken along the line 2—2 of FIG. 1.

FIG. 3 is a partial view taken along the line 3—3 of FIG. 2.

FIG. 4 is an exploded partial perspective view of the detail taken along line 4—4 of FIG. 1.

DESCRIPTION OF THE PREFERRED EMBODIMENTS

Figure 5:
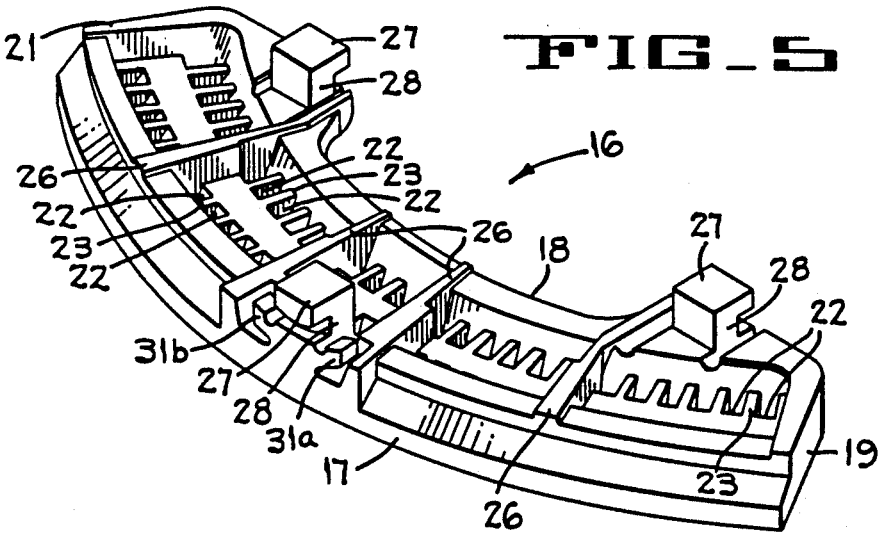
FIG. 5 is a perspective view of one embodiment of the segment of the present invention.

The gutter broom assembly and broom segment are seen in a preferred embodiment in FIG. 1 of the drawings. A broom support plate 11 is shown having a circular shape and a centrally disposed hole 12. A circular pattern of holes 13 is shown for mounting the broom support plate to a power source for driving the support plate rotationally about the center thereof. A number of "L" shaped holes 14 (FIG. 4) are seen to be formed in a pattern through the support plate 11. A number of arcuate brush segments 16 (5 in the embodiment of FIG. 1) are shown in dashed line underlying the broom support plate. Each brush segment may be seen to underlie a similar portion of the overall pattern of holes 14 in the broom support plate.

A preferred embodiment of the brush segment may be seen with reference to FIG. 5. An outer or leading arcuate edge 17 of the segment is of relatively thick section to afford segment strength. An inner arcuate edge 18 on the brush segment is also of a relatively thick section to provide additional strength for the segment. Two end walls 19 and 21 together with the inner and outer arcuate edges serve to enclose a number of hole pairs 22. The holes 22 in each pair are separated by a wall 23. The hole pairs serve to accept a folded bundle of gutter brush bristles therethrough which are limited in their extension from the brush segment by contact between the bight of the folded bundle and the wall 23. The bristles 24 are shown extending through one of the holes 22 supported at the bight of the bristle bundle by the wall 23 in the sectional view of FIG. 2. Bristles are not shown in place in the segment of FIG. 5 for the sake of clarity.

The pairs of holes 22 separated by wall 23 are disposed in two arcuate rows, as best seen in FIG. 5. Ribs 26 extend in a radial direction relative to the arc of segment 16 to provide further rigidity and strength to the segment. Segment strength is a relatively important characteristic because gutter brooms are subjected to a relatively severe environment, including high shock loads, and are advantageously made of some material which is tough and easily molded, such as high density polyethylene. Such gutter broom segments are well defined in U.S. Pat. No. 3,875,607, issued Apr. 8, 1975 to R. B. Rosseau and currently assigned to the assignee of the instant invention.

FIG. 5 also shows a pattern of projecting square lugs 27 that extend upwardly from the brush segment 16. The lugs take the form of a rectangular boss having a narrowed neck portion 28. The neck portion has a heighth dimension which is sufficient to receive the thickness of the broom support plate 11, as may best be seen with reference to FIG. 2. The square upper portion or head of the lug 27 is shaped to pass through the lower or base leg of the "L" shaped holes 14. When all three lugs 27 on a segment 16 are aligned with three of the "L" shaped holes 14 in the support plate 11, the segment may be lifted toward a lower bearing surface 11*a* (FIGS. 2 and 3) on the support plate so that the upper surfaces of the segment (of the ribs 26, end walls 19 and 21, etc.) are in contact with the support plate bearing surface. Subsequently the segment 16 may be moved parallel to the bearing surface in a direction oriented orthogonally to a radial line from the center of the support plate (to the left relative to the support plate in FIG. 4), and the narrowed neck portion 28 of the projecting square lug enters the upstanding leg or slot 14*a* of the "L" shaped hole 14.

With the lugs 27 positioned within the portion 14*a* of the "L" shaped holes, a convex portion 28*a* of the narrowed neck on the lugs is compressed by contacting the edge of the hole portion 14*a*. This compression of the segment lug material serves to assist in retaining the lug in the locked position in the upstanding leg 14*a* of the "L" shaped hole.

Additionally or alternatively a convex surface 29 may be formed on that surface of the notch formed by the neck portion 28 on the lug 27 which is adjacent to the neck portion, as best depicted in FIGS. 2 and 3. The convex portion 29 is formed so that it will be compressed by the thickness of the support plate 11 as shown in FIG. 3 of the drawings. As may also be seen in FIG. 3, a pair of upwardly inclined dogs 31*a* and 31*b* are disposed on either side of the square lug 27. The dogs are formed to flex at their narrow connecting portions to the base of the lugs 27 so that they may be depressed downwardly by the plate 11 as shown by the position of the dog 31*b* in FIG. 3. The oppositely disposed dog 31*a*, however, when the narrowed neck portion 28 of the lugs is positioned in the upstanding leg or narrowed portion 14*a* of the holes 14 is free to spring upwardly into the space provided by the lower leg of the "L" shaped hole. This is shown in dotted lines in FIG. 3. As a consequence, any force exerted against the segment to move it to the right relative to the support plate 11 as seen in FIGS. 3 and 4 will be resisted by contact between the dog 31*a* and the edge of the hole 14 to which it is adjacent. Additionally, the lugs 27 are held in the portions 14*a* of the holes 14 by virtue of the rotation of the support plate in the direction shown by arrow 32 in FIG. 1. The dogs 31*a* and 31*b* take the configuration shown in FIGS. 3 and 4 because the support plate in the configuration shown in FIG. 1 may be turned over and the same segment 16 may be inserted into and locked thereon. The relative locking motion is then opposite that described in conjunction with FIG. 4 hereinbefore. Such gutter brooms are then configured for rotation in a sense opposite to that shown by the arrow 32 in FIG. 1. Therefore, the configurations of support plate 11 and segment 16 shown in the drawings are fully capable of assembly to produce brooms configured for clockwise or counterclockwise rotation without any modifications to or differences in the assembly parts.

Figure 6:
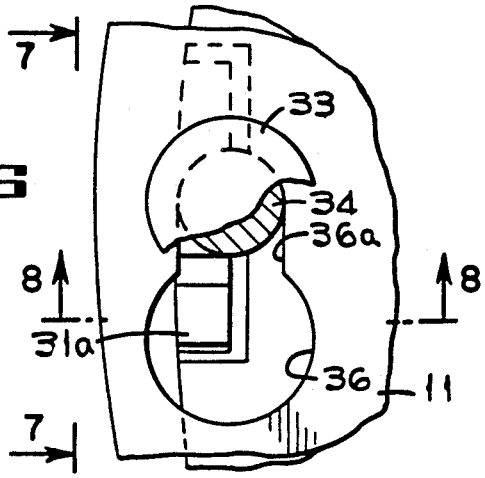
FIG. 6 is a detail view of an alternative embodiment of the lug and locking means of FIGS. 2, 3 and 4.
Figure 7:
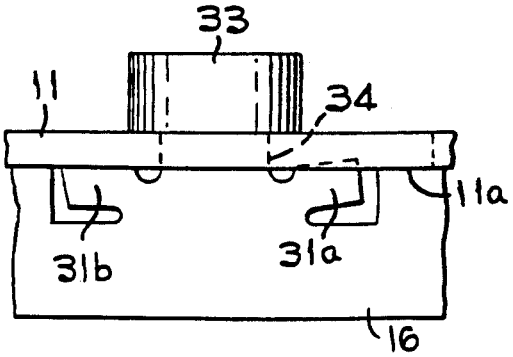
FIG. 7 is a partial view along the line 7—7 of FIG. 6.
Figure 8:
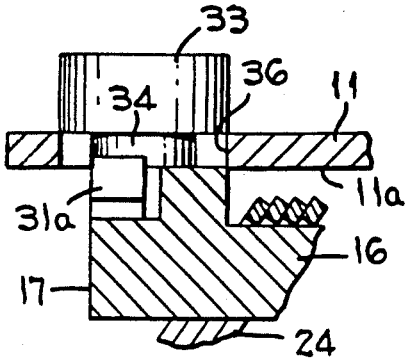
FIG. 8 is a partial sectional view along the line 8—8 of FIG. 6.

Turning now to FIG. 6 an alternative embodiment for securing the segments 16 to the broom support plate 11 will be described. In place of the square lugs 27, FIGS. 6, 7 and 8 show a round or cylindrical lug 33 having a narrowed neck portion or stem 34. The cylindrical lugs 33 are placed on the brush segment 16 in the same pattern as shown for the square lugs 27. The locking dogs 31*a* and 31*b* are seen to be identical to the locking dogs having the same item numbers described in association with the embodiment of FIGS. 2, 3 and 4 and shown as well in FIG. 5.

The manner in which the lugs 33 function to affix the segment 16 adjacent the bearing surface 11*a* of the broom support plate 11 may be seen with reference to FIGS. 6, 7 and 8. The upper cylindrical portion 33 of the three lugs on the segment are aligned with a portion of a pattern of key hole shaped holes 36 formed in the support plate. The pattern is similar to that shown for the "L" shaped holes 14 in FIG. 1. The three cylindrical lugs 33 on the brush segment 16 are brought into registration with a portion of the pattern of key shaped holes 36 and the lugs 33 are pushed upwardly to cause the lugs to pass through the larger portion of the key hole shaped holes. The segment 16 with the lugs 33 extending through the holes 36 and the upper surface thereof adjacent to the bearing surface 11*a* on the support plate, is thereafter moved in a direction parallel to the bearing surface to bring the narrowed neck or stem 34 on each of the lugs 33 into the narrower slot portion 36*a* of the key hole shaped holes. The stem 34 may be constructed to provide a compression fit with the hole portion 36*a* and/or the length of the stem may be made to provide a compression fit with the thickness of the support plate 11. As described hereinbefore with regard to the action of the upwardly inclined dog 31*a* in the embodiment of FIGS. 2, 3 and 4, the dog 31*a* limits the motion of the lug 33 toward the larger portion of the key shaped hole 36 by engaging the edge of the largest portion of the hole. Also as described hereinbefore, the configuration of the segment 16 and the holes 36 in the support plate 11 are such that by reversing the support plate the segment may be locked thereon adjacent the opposing surface shown as 11*a* to provide for gutter broom assemblies capable of securely holding segments during rotation having a sense opposite to that shown by arrow 32 in FIG. 1.

It is envisioned that the arcuate segments 16 will be used optimally in a set of five and will have small spaces between the ends of adjacent segments of approximately one and one-half inches. The clearance between the ends of the segments is necessary because when the locking lugs are inserted through the holes in a portion of the pattern of holes formed on the broom support plate 11 they must then be moved about one inch relative and parallel to the support plate bearing surface 11*a* to become fully engaged in the locked position. Each plate which forms the circumference of a gutter broom must be able to be placed or displaced from the support plate independently. The short gap between adjacent segments in some embodiments of the disclosed gutter broom will not be noticeable at the periphery of the bristle array supported by the segments.

Figure 12:
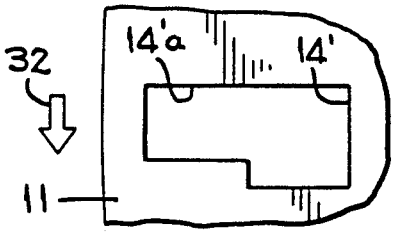
FIG. 12 is a partial view of an alternative embodiment of the broom support plate shown in FIGS. 1–4.

Segments may be attached and locked on a support plate 11 in a fashion such that minimal gap exists between the ends of adjacent segments if the holes in the pattern of holes on the support plate are oriented so that a relative motion between the plate and the segment 16 occurs in a direction parallel to a radial of the support plate. Such an embodiment is illustrated in FIG. 12 where an "L" shaped hole 14' is oriented with the upstanding leg or narrow portion of the "L" extending radially on the plate. The lug 27 for entry into the hole 14' shown in FIG. 12 would then have to be formed on the segment 16 in a position rotated 90° counterclockwise from that shown in FIG. 5. The other two lugs would be formed in positions rotated 90° clockwise, and all holes 14' would be oriented as shown in FIG. 12.

The segment 16 is then placed under the support plate 11 and the lugs aligned with the larger portions of the holes 14'. The lugs are pushed up through the holes and the segment moved outward in a direction parallel to the radius of the support plate and the bearing surface 11*a* thereof. The lugs are captured in the upstanding leg portions 14'*a* of the "L" shaped holes in the same fashion as explained for the embodiment of FIGS. 1–4.

Figure 9:
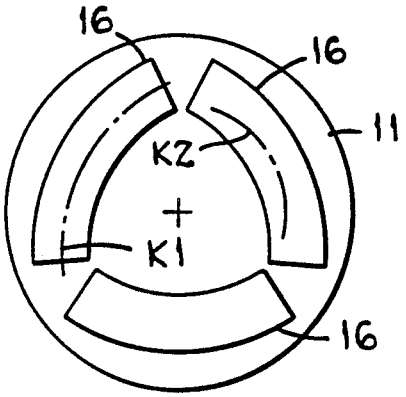
FIG. 9 is a plan view of one embodiment of the gutter broom of the present invention.

However, it has been found that interruptions in the periphery of a broom formed by a plurality of segments supported on a broom support plate will enhance the capability of the broom to agitate certain larger articles of debris such as beer bottles, cans or rocks which may lie adjacent a curb along a gutter to be swept. These interruptions or discontinuities in the broom periphery may be obtained in a number of ways. With reference to FIG. 9, it may be seen that three arcuate segments 16 are mounted at a mounting radius K2 on a broom support plate 11 which is smaller than the radius of curvature K1 of the segments. The resulting configuration shown in FIG. 9 provides what may be termed "cam lobes" at the positions on the periphery of the brush corresponding to the positions of the ends of adjacent brush segments. It may be seen that rotation of the brush assembly of FIG. 9 at a constant speed will impart greater energy to articles of debris which are struck by the "cam lobes" than when struck by portions of the brush periphery intermediate the "cam lobes". In this fashion, a beer bottle or a rock will be deflected away from the gutter wall formed by a curb and into the path of a centrally located cylindrical pick-up broom rather than being pushed gently along the gutter wall by a brush having a substantially uninterrupted circular periphery.

Figure 10:
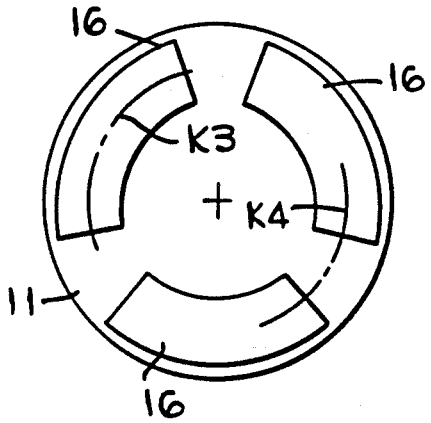
FIG. 10 is a plan view of an alternative embodiment of the gutter broom of the present invention.
Figure 11:
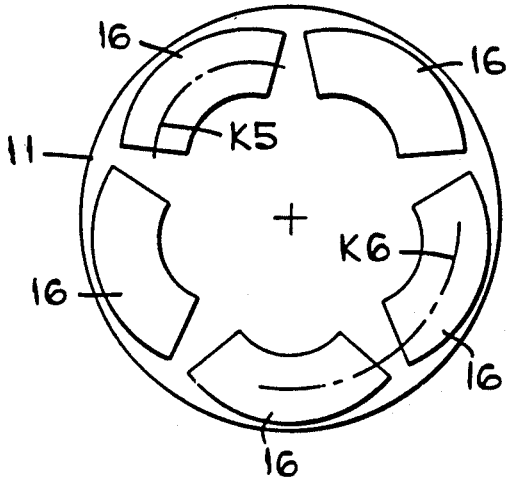
FIG. 11 is a plan view of yet another embodiment of the gutter broom of the present invention.

FIG. 10 shows three segments 16 mounted on a broom support plate wherein the arcuate length of the combined three segments is considerably less than the circumference at the mounting radius on the plate for the segments. The radius of curvature K3 of the segment is substantially the same as the mounting radius K4. As a result, a considerable gap or discontinuity is present between the ends of adjacent brush segments, which discontinuity extends to the ends of the bristles supported by the segments. In a fashion similar to that described for the operation of the embodiment of FIG. 9, the discontinuities in the periphery of the gutter broom assembly impart differing levels of energy to larger articles of debris such as cans, bottles or rocks and the articles are more readily deflected from the gutter wall into the path of the aforementioned centrally located cylindrical pick-up broom on a street sweeper. Another embodiment for accomplishing the ends recited for the embodiments of FIGS. 9 and 10 is shown in FIG. 11. Five brush segments 16 are shown mounted at a mounting radius K6 on a broom support plate 11 which is larger than the radius of curvature K5 of the brush segments. As a consequence, the aforementioned "cam lobes" described in connection with the embodiment of FIG. 9 are formed at the central portions of the segments 16. The "cam lobes" which extend to the periphery of the broom assembly at the bristle ends. The impact of the "cam lobes" on larger articles of debris such as cans, bottles and rocks imparts greater energy to such articles and they are more readily deflected from a position adjacent a curb wall in a gutter into the path of a centrally located cylindrical broom. Thus, the increased agitation of the articles of debris being swept from the gutter by the broom causes the articles to be picked up more readily from the surface being swept and prevents such debris from being pushed down the gutter wall ahead of the gutter broom and thereby piling up to perhaps be lost by the sweeper at driveways or intersections.

Although the best mode contemplated for carrying out the present invention has been herein shown and described, it will be apparent that modification and variation may be made without departing from what is regarded to be the subject matter of the invention.

What is claimed is:

1. In combination with a gutter broom for use on a surface sweeper, the broom having a plurality of segments holding downwardly projecting bristles and a broom support plate that mounts the segments, the support plate being adapted to be coupled to a power source to rotationally drive the broom, an improvement in the means for mounting the segments to the support plate comprising:

(a) the support plate having a top, a bottom and a pattern of lug holes, each lug hole having a large portion and a narrower slot portion;

(b) a plurality of upstanding lugs of each segment, each lug having a head at its top and a neck connecting the head to the segment, the heads bearing on the support plate top while the segments bear against the support plate bottom to hold the segment to the support plate, each head having a horizontal cross section small enough to pass through the enlarged portion of an associated one of the holes of the support plate and larger than such hole's slot, the neck having a horizontal cross section smaller than the head and small enough to be received in such slot, the lug of each segment being in a pattern corresponding to the lug hole pattern in the support plate so that the during mounting of the segment to the support plates the heads of the lugs pass through corresponding large portions of associated holes of the support plate and the necks slide into the slot portons so that the heads of the lugs bear on the plate and hold the segment to the plate; and (c) locking means for each of the segments including at least one resilient dog adjacent one of the lugs of each segment, each dog having a locking position in which such dog engages the edge of the large portion of the lug hole that receives the adjacent lug to prevent movement of the adjacent lug's neck into the enlarged portion of such hole and thereby lock the segment to the support plate, the dog being in position to be displaced away from its locking position to a second position upon being forced against the bottom of the plate during insertion of the adjacent lug's head into the enlarged portion of the hole that receives such lug so that the adjacent lug's neck can move into the slot of such hole with such head bearing on the support plate top and upon such movement the dog is freed from the bottom of the plate and displaces into its locking position.

2. The improvement claimed in claim 1 wherein the two positions of the dog are vertically separated with respect to the support plate and the resiliently of the dog biases the dog toward its locking position.

3. The improvement claimed in claim 2 including a second of the resilient dogs adjacent at least one of the lugs and extending in the opposite horizontal direction from the other dog to accommodate turning the support plate over and reversing the direction of the slots from the enlarged openings.

4. The improvement claimed in claim 1 wherein the lug holes are "L" shaped with one leg of the "L" being the slot and the other leg of the "L" being the enlarged opening.

5. The improvement claimed in claim 1 wherein the locking means includes a convex surface on the neck of at least one of the lugs of each segment for compression by the wall of the slot receiving such lug.

6. The improvement claimed in claim 1 wherein the locking means includes a convex surface under the head of at least one of the lugs of each segment for compression by the support plate.

7. The improvement claimed in claim 1 wherein the support plate has a rotational center and the slots in the lug hole pattern are divided into individual groups with each group corresponding to one of the segments, the slots of each group being orthogonal to a single radius for such group from the support plate rotational center.

8. The improvement claimed in claim 1 wherein the support plate has a rotational center and the lug hole pattern is divided into individual groups with each group corresponding to one of the segments, the slots of each group being parallel to a single radius extending from the support plate rotational center.

9. The improvement claimed in claim 1 wherein the pattern of lug holes comprises a plurality of key hole shaped openings.

10. A gutter broom segment for use in a surface sweeping broom having a broom support plate adapted to be rotationally driven and a plurality of lug holes for mounting several of the segments, each lug hole having a narrow slot and an enlarged opening, the segment comprising:

(a) a body having a top and a bottom;

(b) a plurality of pairs of bristle passages in the body separated into pairs by medial walls of the body, each wall being capable of supporting the bight of a folded bristle bundle, each pair of passages extending from the top to the bottom and being oriented at an angle that effects an outward and downward orientation the bristle bundles when the segment is mounted to the support plate;

(c) a plurality of mounting lugs extending upward from the top of the body for receipt in a corresponding number of the lug holes in the support plate, each lug having a neck for receipt in the slot of one of the lug holes and a heat on the neck for engaging the top of the support plate adjacent the slot to hold the segment to the support plate; and (d) a resilient dog adjacent at least one of the lugs in position to bear against the underside of the support plate and to deflect away from such lug from a relaxed position of the dog upon the insertion of the head of such lug into the enlarged portion of an associated one of the lug holes and, when the neck of such lug enters the slot of such hole, to clear the underside of the support plate and spring back to the relaxed position in the enlarged portion of the lug hole to prevent the lug neck from moving out of such slot.

11. The improvement claimed in claim 10 including a second resilient dog adjacent at least one of the lugs and extending in the opposite horizontal direction from the other dog to accommodate turning the support plate over and reversing the direction of the slots from the enlarged openings.

12. The improvement claimed in claim 10 wherein the locking means includes a convex surface on the neck of at least one of the lugs for compression by the wall of the slot of an associated hole.

13. The improvement claimed in claim I0 wherein the locking means includes a convex surface under the head of at least one of the lugs for compression against the support plate.

* * * * *

UNITED STATES PATENT AND TRADEMARK OFFICE

CERTIFICATE OF CORRECTION

PATENT NO. : 4,765,013

DATED : August 23, 1988

INVENTOR(S) : James T. Lowe

It is certified that error appears in the above-identified patent and that said Letters Patent is hereby corrected as shown below:

On the Front Page

| | |
|---|---|
| [73] Assignee: | Change "FMC Corporation, Chicago, Ill." to -- Industrial Brush Corporation, Pomona, CA --. |

In the Specification

In the Claims

| | |
|---|---|
| Column 6, Line 28 | Change "the during" to -- during the --. |
| Column 6, Line 32 | Change "portons" to -- portions --. |
| Column 6, Line 55 | Change "resiliently" to -- resiliency --. |
| Column 8, Line 7 | Change "heat" to -- head --. |

UNITED STATES PATENT AND TRADEMARK OFFICE

CERTIFICATE OF CORRECTION

PATENT NO. : 4,765,013

DATED : August 23, 1988

INVENTOR(S) : James T. Lowe

It is certified that error appears in the above-identified patent and that said Letters Patent is hereby corrected as shown below:

Column 8, line 31, after "claim" change "IO" to -- 10 --.

Signed and Sealed this

Fourteenth Day of February, 1989

*Attest:*

DONALD J. QUIGG

*Attesting Officer*

*Commissioner of Patents and Trademarks*